United States Patent [19]

Sinoto

[11] 4,202,461

[45] May 13, 1980

[54] POP-OPEN CONTAINER LID

[76] Inventor: Nori Sinoto, 345 W. 58th St., New York, N.Y. 10019

[21] Appl. No.: 2,668

[22] Filed: Jan. 11, 1979

[51] Int. Cl.[2] ..... B65D 41/32

[52] U.S. Cl. ..... 220/268

[58] Field of Search ..... 220/268-274, 220/277; 222/541

[56] References Cited

U.S. PATENT DOCUMENTS

| | | | |
|---|---|---|---|
| 3,362,569 | 1/1968 | Geiger | 220/268 |
| 4,128,186 | 12/1978 | Gane | 220/268 |

*Primary Examiner*—George T. Hall

*Attorney, Agent, or Firm*—Shenier & O'Connor

[57] ABSTRACT

A pop-open container lid stamped from a sheet of metal or the like to form a finger receiving recess and a surrounding recess and an intermediate annular ridge with an inner wall extending downwardly from the ridge to the base of the finger receiving recess and with a peripheral wall extending downwardly to the base of the surrounding recess. A scoring line extends from the base of the surrounding recess at a location adjacent to the edge of the lid inwardly and slightly upwardly along the inner surface of the peripheral wall to spaced points located between the top and bottom of the peripheral wall and thence to terminal points in the plane of the said sheet to form a fracture line and a hinge. Ribs on the outer surface portion of the inner wall facilitate fracturing and twisting of the lid by squeezing and subsequent rotation of the finger recess forming portion around the hinge inwardly and sideways of the can edge away from the edge which is formed along the fracture line.

11 Claims, 6 Drawing Figures

POP-OPEN CONTAINER LID

BACKGROUND OF THE INVENTION

There have been many efforts in the prior art to develop alternatives to the pull-tab container lids generally used for manually opened beverage containers. While pull-tab lids make it unnecessary to use a separate opener, the tabs themselves become separated from the containers when they are used, creating a disposal problem. Because of their sharp edges, the tabs may also cause injury if they are not properly pulled.

One alternative to the pull-tab container lid has been the so-called pop-in lid, which generally has a button-shaped portion formed with a peripheral scoring. To open, the user presses downwardly on the button-shaped portion, rupturing the lid along the scoring line to permit the portion to be bent inwardly. While this alternative solves the disposal problem, it creates a safety problem of its own, as the user may cut his finger on the ruptured scoring line at some stage of the opening process. Both of the lids discussed hereinabove permit the pressure of the contents to escape upwardly as the can is opened and possibly into the user's face.

SUMMARY OF THE INVENTION

One of the objects of my invention is to provide a pop-open container lid which may be opened without using a separate opener.

Another object of my invention is to provide a pop-open container lid which has no removable part.

Still another object of my invention is to provide a pop-open container lid which will not injure the user or others when it is used.

A still further object of my invention is to provide a pop-open container lid which is relatively simple to manufacture.

Yet another object of my invention is to provide a pop-open container lid which will not readily open accidently.

A still further object of my invention is to provide a pop-open container lid which inhibits escape of pressure upwardly when the lid is opened.

Other and further objects of my invention will be apparent from the following description.

In general, my invention contemplates a pop-open container lid comprising a generally planar sheet of metal formed with a finger recess having a rounded upper rim and inner peripheral walls descending from the rim respectively to the bottom of the finger recess and to the bottom of a hinge-forming recess extending around the finger recess. The intermediate wall is formed with a scoring line around the outer portion thereof to facilitate the fracture of the lid along the scoring line to form an opening by pressing a finger outwardly against the inner wall. I provide the inner wall with lateral and vertical ribbing along the pressed portion thereof to permit the fractured lid portion to be swung upwardly and sideways from the can edge to expose the opening by pulling sideways against the ribbing.

BRIEF DESCRIPTION OF THE DRAWINGS

In the accompanying drawings to which reference is made in the instant specifications and in which like reference characters are used to indicate like parts in the various views.

DETAILED DESCRIPTION OF THE PREFERRED EMBODIMENT

Figure 1:
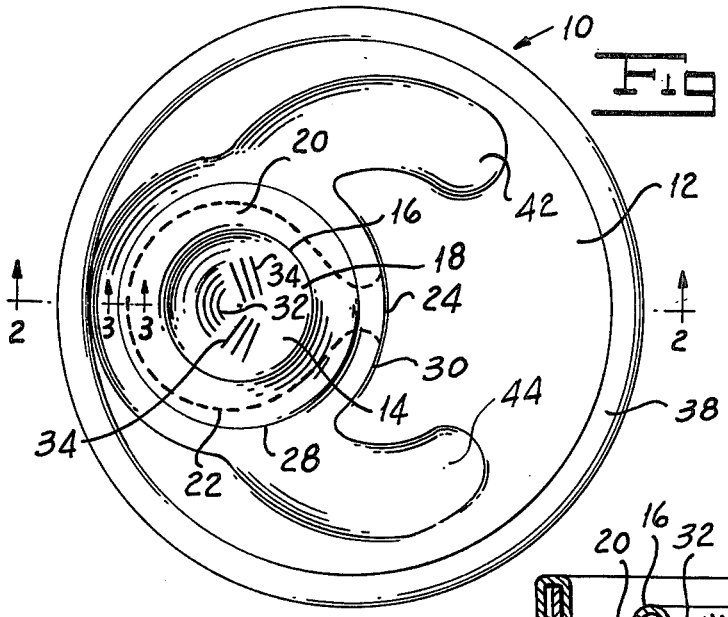
FIG. 1 is a top plan of my container lid applied to the top of the beverage container.
Figure 3:
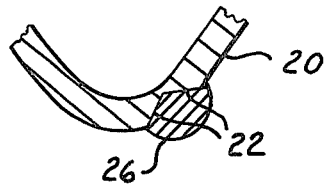
FIG. 3 is an enlarged fragmentary section of my container lid, taken along line 3—3 of FIG. 1, showing the scoring in greater detail.

Referring now to the drawings, my container lid, indicated generally by the reference character 10. comprises a generally planar circular sheet of metal 12 formed with a concave finger recess 14 surrounded by a second trough 28 preferably at a location near the edge of the lid 10. An annular ridge 16 connects the peripheral wall recesses 14 and 28 so that an inner wall 18 and a peripheral wall 20 extend from ridge 16, respectively, to the bottom of recess 14 and to the bottom of trough 28.

I so form the recesses 14 and 28 as to provide the inner wall 18 with a surface area in the outer region whereat the wall is gripped in opening the can in a manner to be described.

Figure 2:
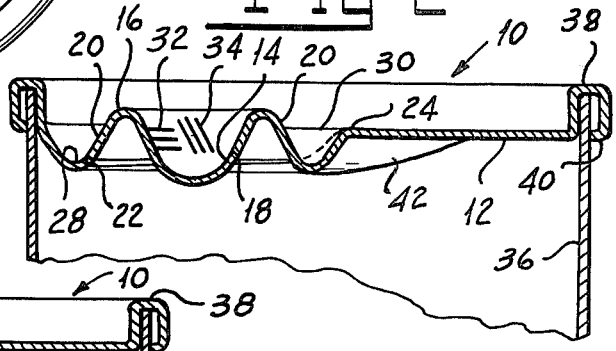
FIG. 2 is a fragmentary section of my container lid taken along line 2—2 of FIG. 1.
Figure 4:
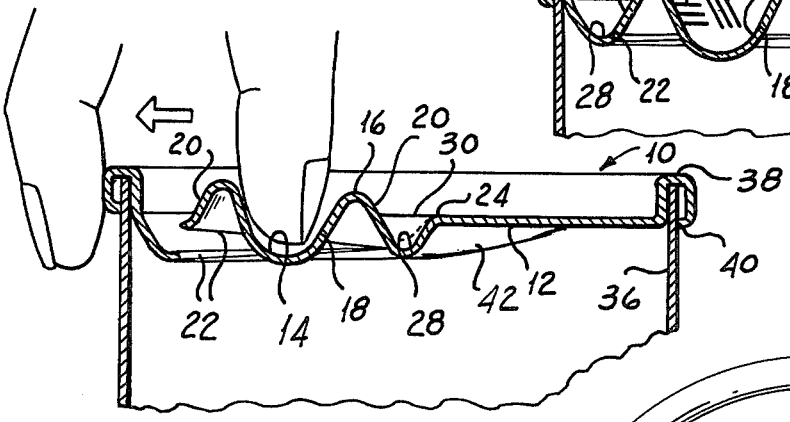
FIG. 4 is a fragmentary section of my container lid showing the first step in opening the can.
Figure 5:
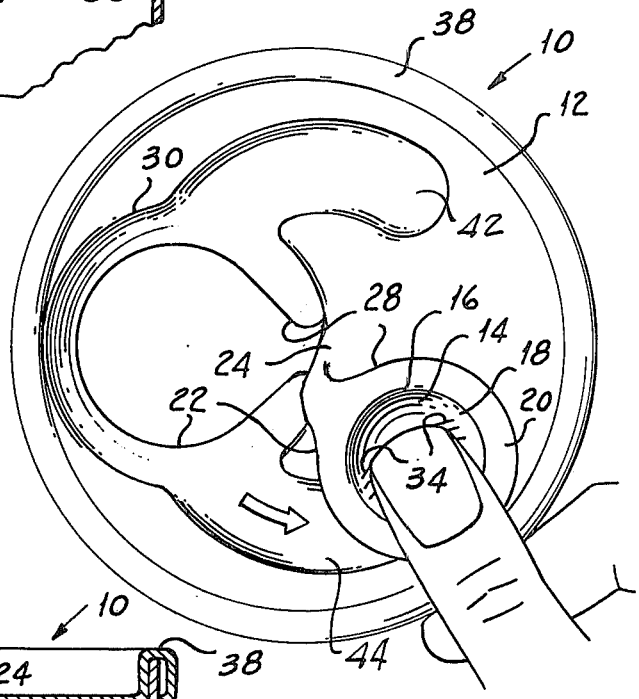
FIG. 5 is a fragmentary section of my container lid showing the second step in opening the can.

I provide a line of scoring 22 on the inner surface of wall 20 and extending from the base of recess 28 upwardly at a location adjacent to the edge of the lid inwardly and slightly upwardly as viewed in FIGS. 2, 4 and 5 to spaced points located between the top and bottom of the wall 20 and thence to terminal points at the outer edge 30 of recess 28 so that the portion of the wall 20 between the terminal points forms a hinge 24. I apply a sealer 26 along the line of scoring 22 to ensure an airtight seal.

I also form a plurality of lateral ridges 32 and vertical ridges 34 on the portion of the inner wall 18 remote from the hinge 24 and nearest the lid edge. I fit the lid 10 on the open top of a beverage container 36 by bending an upper rim portion of the container 36 downwardly to form a flange and then swaging the peripheral portion 40 of rim portion 38 of the lid 10 around the flange in a manner known to the art. Any other suitable means may be employed to assemble the lid on the can.

To facilitate the formation of the initial fracture at the base of the peripheral wall 20 remote from the hinge 24, the scoring line 22 is tapered so as to be deepest near the lid edge. Preferably, for ease of die cutting, the generally vertical wall of the scoring line 22 faces slightly downwardly. For ease of manufacture, the wall 20 is formed as shallow as possible consistent with easy opening.

Figure 6:
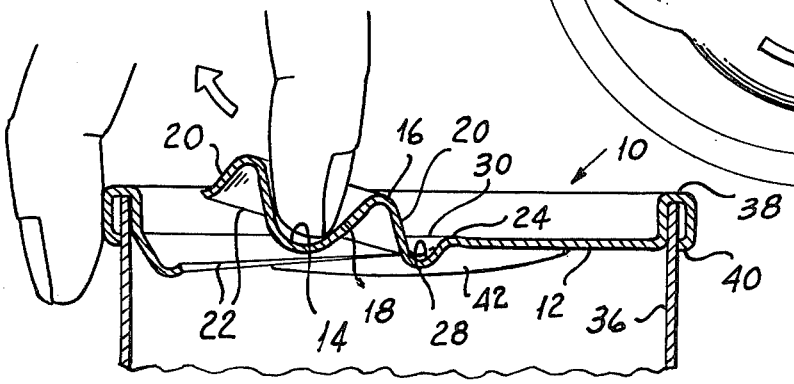
FIG. 6 is a top plan of my container lid showing the third step in opening the can.

To fracture the lid 10 to form an opening, the user inserts his finger into the finger recess 14 and presses outwardly against the inner wall 18, as shown in FIGS. 4 and 5, causing a fracture along the scoring line 22 and displacing outwardly the portion of the rim 16 nearest the lid edge. This may be a squeezing action. The user then slightly raises and then swings the fractured portion to expose the opening by pressing upwardly and sideways against the ridges 32 and 34, as shown in FIGS. 5 and 6. In this manner, the sharp edge is moved away from the user's face if he is drinking from the can.

The recess-forming portion may be twisted all the way completely to expose the opening formed by the fracture. Alternatively, the hinge 24 may be formed at an angle so that the recess-forming portion can be swung more easily to one side. The user is thus able to open the lid without using a separate opener, without creating extra pieces to dispose of, and without coming into contact with any sharp edges.

It will be appreciated that the formation of the finger recess 14 in conjunction with the surrounding trough 28 permits me to form the pop-open top as described above without producing the unsightly and perhaps accidently openable arrangement. It will be seen moreover that my pop-open top may be formed by use of relatively inexpensive dies and in a simple progressive stamping operation. My lid inhibits escape upwardly of the pressurized contents of the can. It is to be noted that the slanted scoring line 22 permits raising the initially fractured portion and the finger recess 14 naturally to the height for easy sideways swinging. Furthermore, the last fractured portions of the wall 20 between the ridge 16 and the hinge 24 collapses at one side of the hinge and extends at the other side for easy sideways swinging. Preferably, I also form the lid 12 with respected recesses 42 and 44 along which the fractured part can be swung in one direction or the other completely to expose the can opening.

It will be seen that I have accomplished the objects of my invention. I have provided a pop-open container lid which has no removable part. My pop-open lid is safe. It is relatively inexpensive to construct for the result achieved thereby.

It will be understood that certain features and subcombinations are of utility and may be employed with reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A pop-open container lid comprising a generally planar sheet formed with a first wall disposed at an angle with respect to said sheet to provide a surface against which pressure may be exerted in a direction generally parallel to said sheet, a second wall disposed at an angle with respect to said sheet, said second wall being frangible along a line, and means connecting upper ends of said walls to cause said second wall to break along said line in response to pressure exerted on said first wall generally in the direction of said sheet, a portion of said sheet adjacent to said second wall and remote from said second wall being free of obstacles over a space sufficient to render said second wall accessible to a digit of a user to permit the user's digit to engage said wall and to exert said pressure thereon in the direction of said second wall.

2. A pop-open container lid as in claim 1 in which each of said angles is an oblique angle.

3. A pop-open container lid as in claim 1 including means forming a hinge connecting said first wall to said sheet.

4. A pop-open container lid as in claim 1 in which said first wall is formed by a finger recess and in which said second wall extends generally downwardly from said first wall.

5. A pop-open container lid as in claim 4 in which said frangible portion of said second wall comprises scoring extending partially around said second wall to terminal points in the planar part of said sheet whereby the portion of said sheet between said terminal points forming a hinge.

6. A pop-open container lid as in claim 5 including a peripheral recess in said sheet around said finger recess, said line extending from a location adjacent to the base of said peripheral recess partially around said second wall and then upwardly to said terminal points.

7. A pop-open container as in claim 6 in which the distance between said terminal points is such as to permit said finger recess forming portion of said sheet to be swung laterally of said top by folding of the portion of said sheet between said hinge and said second wall.

8. A pop-open container as in claim 7 including a recess in said sheet to accommodate said swinging movement of said finger recess forming portion.

9. A pop-open container lid as in claim 8 in which said line is a scoring line which is relatively deep along one portion thereof and is relatively shallow along another portion remote from said first portion.

10. A pop-open container lid as in claim 9 in which the depth of said line is tapered between said deep portion and said shallow portion.

11. A pop-open container lid as in claim 10 in which said scoring line is formed on the underside of said peripheral wall.

* * * * *